US005460486A

United States Patent [19]

Evans et al.

[11] Patent Number: 5,460,486

[45] Date of Patent: Oct. 24, 1995

[54] GAS TURBINE BLADE HAVING IMPROVED THERMAL STRESS COOLING DUCTS

[75] Inventors: Neil M. Evans, Bristol; Paul Hayton, Acomb York; Stephen H. Hill, Gloucestershire, all of Great Britain

[73] Assignee: BMW Rolls-Royce GmbH, Germany

[21] Appl. No.: 256,647

[22] PCT Filed: Nov. 10, 1993

[86] PCT No.: PCT/EP93/03146

§ 371 Date: Jul. 19, 1994

§ 102(e) Date: Jul. 19, 1994

[87] PCT Pub. No.: WO94/11616

PCT Pub. Date: May 26, 1994

[30] Foreign Application Priority Data

Nov. 19, 1992 [GB] United Kingdom ..... 9224241

[51] Int. Cl.[6] ..... F01D 5/22; F01D 5/18

[52] U.S. Cl. ..... 416/97 R; 416/191; 415/115

[58] Field of Search ..... 415/115, 116; 416/97 R, 191

[56] References Cited

U.S. PATENT DOCUMENTS

| | | | |
|---|---|---|---|
| 3,529,902 | 9/1970 | Emmerson | 415/115 |
| 3,628,880 | 12/1971 | Smuland | 415/115 |
| 4,017,213 | 4/1977 | Przirembel | 415/115 X |
| 4,127,358 | 11/1978 | Parkes | 416/97 R X |
| 4,353,679 | 10/1982 | Hauser | 415/115 |
| 4,946,346 | 8/1990 | Ito | 415/115 |
| 5,344,283 | 9/1994 | Magowan et al. | 415/115 |

*Primary Examiner*—Edward K. Look
*Assistant Examiner*—Michael S. Lee
*Attorney, Agent, or Firm*—Evenson, McKeown, Edwards & Lenahan

[57] ABSTRACT

A cooled turbine blade is described that has shroud band segment in which three cooling air branch ducts extend essentially perpendicularly to the longitudinal axis of the blade as well as in the circumferential direction of the blade reinforcing band. Cooling air bores branch off the cooling air branch ducts and lead out on the surface of the shroud band segment and form film cooling holes there. A first branch duct is supplied with cooling air by a blade cooling duct which is situated in the leading area, while a second branch duct is connected with another blade cooling duct 13 and the third branch duct is connected with the second branch duct 14.

5 Claims, 2 Drawing Sheets

GAS TURBINE BLADE HAVING IMPROVED THERMAL STRESS COOLING DUCTS

BACKGROUND OF THE INVENTION

The invention relates to a turbine blade of a gas turbine comprising at least one cooling air duct extending in the blade as well as a shroud band segment which is arranged on the blade tip and which, together with additional segments of adjacent blades, forms a blade reinforcing band, a cooling air branch duct is provided which extends in the shroud band segment essentially perpendicularly to the blade axis, is connected with the blade cooling air duct situated in the leading area of the blade and from which cooling air bores lead to the surface of the shroud band segment.

Such a cooled gas turbine blade is shown in German Patent Document 39 30 324 A1. By means of this type of a cooling of not only the blade but also of the shroud band segment, it can be achieved and the thermal stress and the geometrical deformations can be kept low to which the blade and the segment are subjected as a result of thermal influences. Although the thermal stress to a turbine blade is already considerably reduced by means of the known cooling air guiding, additional improved cooling measures are desirable which are the object of the present invention.

SUMMARY OF THE INVENTION

For achieving this and other objects, the present invention provides that at least one additional cooling branch duct extends in the shroud band segment and is connected with another blade cooling duct situated in the trailing area of the blade or in the blade center and from which cooling air bores also lead to the surface of the shroud band segment.

Since, as known, a shroud band segment extends along the whole blade cross-section and may therefore have a relatively large surface, an effective cooling by means of only a single cooling air branch duct as well as the cooling air bores branching away from it cannot be sufficient. According to the invention, at least two cooling air branch ducts are therefore provided which preferably extend essentially in parallel and which are each supplied directly by a separate blade cooling air duct and which cause, in each case, particularly via branching film cooling holes or convection cooling bores, an effective cooling of essentially the whole shroud band segment. While, in this case, on the leading side of the blade or in the blade center area, a sufficiently large amount of cooling air is still available in a blade cooling duct for supplying a connected cooling air branch duct, on the trailing side of the blade in the blade cooling air duct, this amount of cooling air is already reduced to such an extent that a cooling air branch duct which would be supplied by a blade cooling air duct on the trailing side of the blade would receive hardly any cooling air. It is therefore provided in certain embodiments in the shroud band segment close to the trailing area of the blade, in addition, a so-called parallel duct which is supplied with cooling air by an adjacent cooling air branch duct and, for this purpose, is connected with the latter preferably via several cooling air bores. These bores may be the same as those which lead out as film cooling holes on the surface of the shroud band segment. Several cooling air branch ducts as well as the cooling air bores which branch away from them therefore run in a virtually net-type manner through the interior of the shroud band segment and are therefore capable of covering the largest area of the shroud band segment for the purpose of cooling.

The cooling air branch duct as well as the cooling air bores, which clearly have a smaller diameter than the cooling air branch duct, may be placed in the shroud band segment by means of drilling. While, however, the cooling air bores should lead out on the surfaces of the shroud band segment and in this case form film cooling holes or convection cooling bores, the cooling air branch ducts should not lead out on the surface of the shroud band segment because an excessive partial cooling air flow would uselessly escape via the respective cooling air branch duct which has a relatively large cross-section. For this reason, the ends of each cooling air branch duct, which extends preferably along the whole shroud band segment, are closed at the end sides or on the surfaces of the shroud band segment. This closing-off preferably takes place by a subsequent build-up welding.

This advantage as well as additional advantages of the invention are found in the diagrammatic drawing of a preferred embodiment which will be explained in the following.

Other objects, advantages and novel features of the present invention will become apparent from the following detailed description of the invention when considered in conjunction with the accompanying drawings.

DETAILED DESCRIPTION OF THE DRAWINGS

Figure 2:
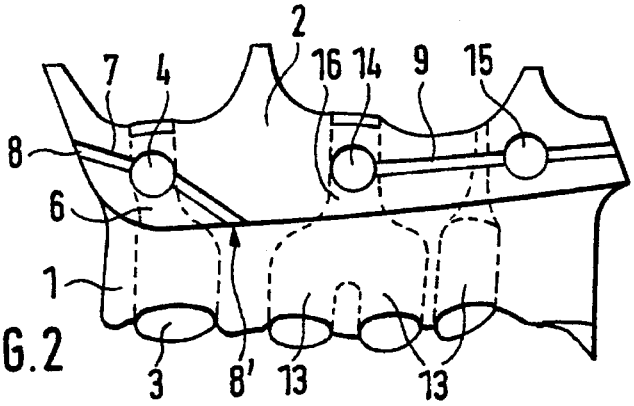
FIG. 2 is the sectional A—A from FIG. 1.
Figure 1:
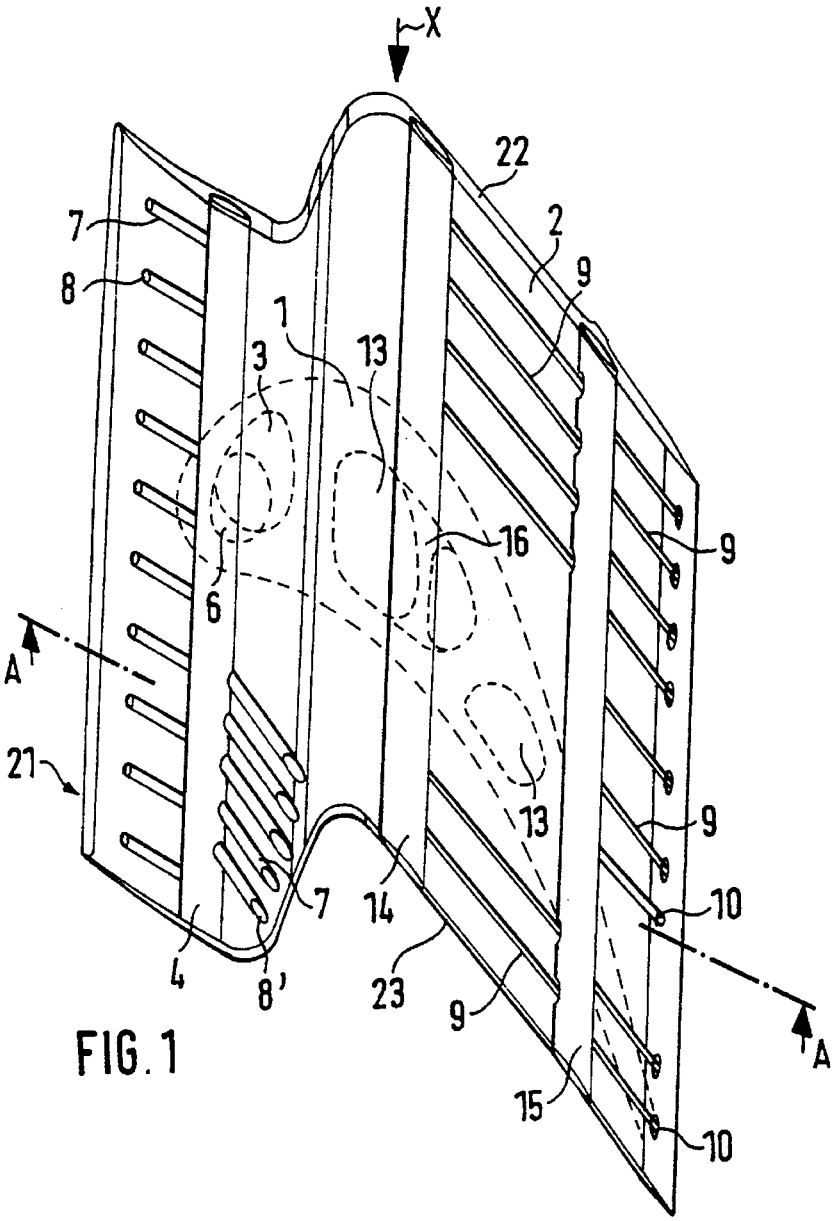
FIG. 1 is a top view of a shroud band segment of a turbine blade according to the invention.
Figure 3:
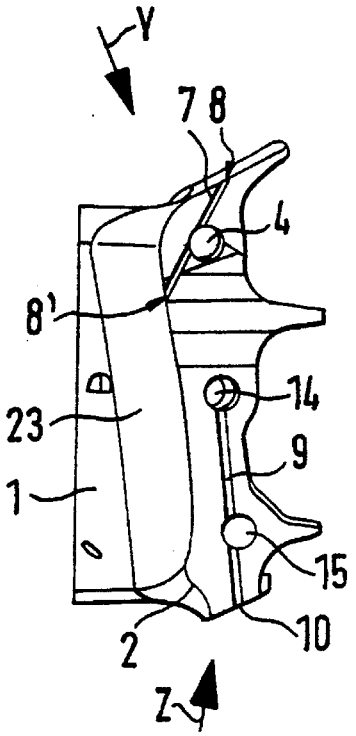
FIG. 3 is view X from FIG. 1.
Figure 4:
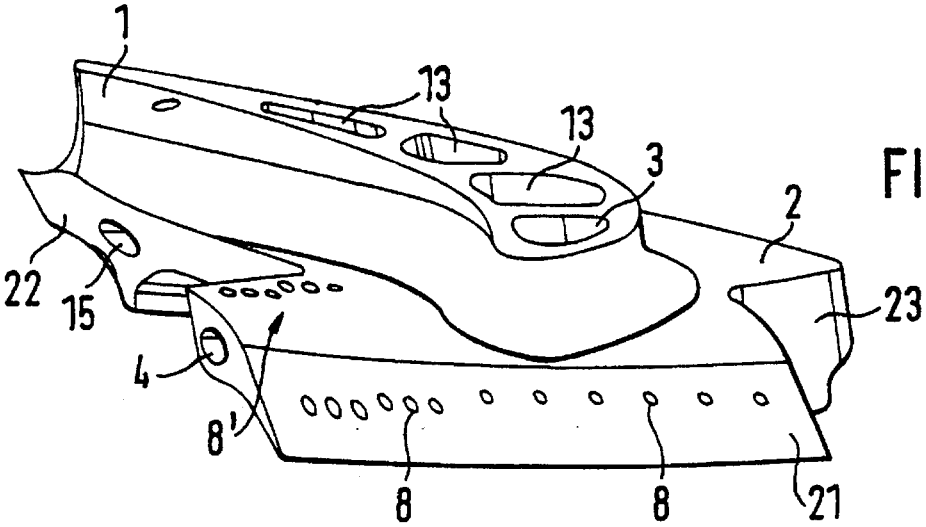
FIG. 4 is view Y from FIG. 3.
Figure 5:
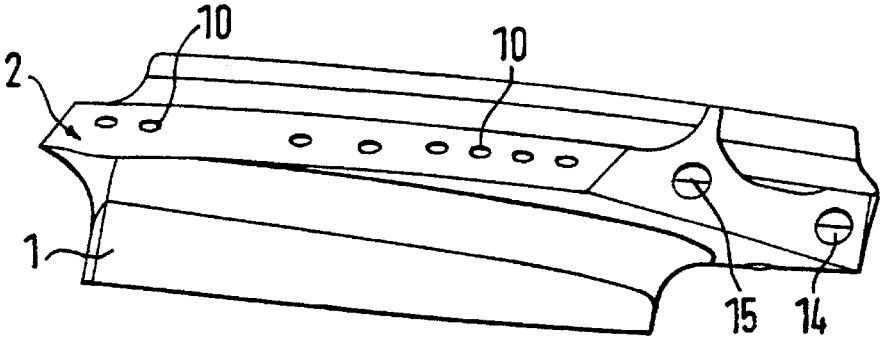
FIG. 5 is view Z from FIG. 3.

Reference number 1 indicates a cooled turbine blade of a gas turbine of which only the blade tip is illustrated in FIGS. 2 to 5. This turbine blade 1 carries a shroud band segment 2.

Via the individual shroud band segments 2 of mutually adjacent turbine blades, a form-locking connection is established between these turbine blades or their shroud band segments 2 by means of a shaping of the edge surfaces 22, 23 so that a surrounding blade reinforcing band is formed.

As known, a forward leading blade side cooling air duct 3 of the blade 1 as well as another system of cooling air ducts 13 which are assigned to the center area of the blade 1 as well as to the trailing blade edge extend within the turbine blade 1. This center or rearward cooling duct system comprises three cooling air ducts 13 which are arranged in series in a meandering manner. The leading blade side cooling air duct 3 as well as the additional system of cooling air ducts 13 operate independently of one another; that is, the cooling air ducts 3, 13 are supplied separately with cooling air.

In the shroud band segment 2, two cooling air branch ducts 4, 14 as well as one parallel branch duct 15 are provided. The branch ducts 4, 14 as well as the parallel branch duct 15 extend essentially in parallel to one another as well as essentially perpendicularly to the longitudinal axis of the turbine blade 1 and, as illustrated, are oriented essentially in the circumferential direction of the blade reinforcing band of a conventional turbine blade arrangement which is not shown and which is formed by a plurality of adjacent shroud band segments 2.

Not only the cooling air ducts 3, 13 of the blades are supplied with cooling air independently of one another but also the cooling air branch ducts 4, 14 in the shroud band segment 2 which are connected with the cooling air ducts of the blade. Thus, via the connecting duct 6, the cooling air branch duct 4 is connected with the cooling air duct 3 of the blade; that is, the cooling air branch duct 4 is supplied with cooling air by the cooling air duct 3 of the blade. A plurality of cooling air bores 7 branch off the cooling air branch duct 4. These cooling air bores 7 lead to the surface of the shroud band segment 2, open out on this surface and in the process form so-called film cooling holes 8 or convection cooling bores 8. This permits a convection cooling in the forward area of the shroud band segment 2 and, in addition, a film cooling of the sealing edge 21 of this shroud segment 2. At the same time, the mutually adjacent edge surfaces 22, 23 of the individual shroud band segments 2 of mutually adjacent turbine blades 1 are cooled particularly by the cooling air flow emerging via the film cooling holes 8'.

Via a connecting duct 16, the second cooling air branch duct 14 is connected with the cooling air duct 13 of the blade. Cooling air bores 9 also branch off the second cooling air branch duct 14 and lead out as film cooling holes 10 or as convection cooling bores 10 also on the surface of the shroud band segment 2 via these cooling air bores 9, which ensure a large-surface cooling of the shroud band segment 2, the parallel branch duct 15, which causes an improved distribution of cooling air, is supplied with cooling air. In this case, only some of the cooling air bores 9 extend from the surface of the shroud band segment 2 beyond the parallel branch duct 15 to the cooling branch duct 14.

By means of the number of these cooling air bores 9, which connect the cooling branch duct 14 with the parallel branch duct 15, the cooling air current can be established which arrives in the parallel branch duct 15.

The cooling air branch ducts 4, 14 as well as the parallel branch duct 15 have a relatively large cross-section and are produced by drilling. These ducts are closed at the ends of the shroud band segment 2, for example, by means of welding. By means of the two cooling air branch ducts 4, 14 as well as the additional parallel branch duct 15 as well as the film cooling holes 8 and the additional convection cooling holes or film cooling holes 10, a uniform effective cooling is achieved not only of the shroud band segment 2 but also of its edge surfaces 22, 23 as well as its sealing edge 21. In this case, a large number of details may have a design which deviates from the shown embodiment without departure from the scope of the claims.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A gas turbine blade having a blade tip, a leading area, a blade center, and a trailing area, and comprising:

at least one first blade cooling air duct extending in the blade and situated in the leading area of the blade;

a shroud band segment arranged on the blade tip of the blade, a plurality of shroud band segments of adjacent blades forming a blade reinforcing band;

a second cooling air branch duct which extends in the shroud band segment essentially perpendicularly to a blade axis, said second cooling air branch duct being connected with the at least one first blade cooling air duct situated in the leading area of the blade, the second cooling air branch duct having a plurality of cooling air bores that lead to the surface of the shroud band segment;

at least one third cooling air branch duct that extends in the shroud band segment, a fourth blade cooling duct situated in at least one of the blade center and the trailing area of the blade and connected with the at least one third cooling air branch duct, the third cooling air branch duct having cooling air bores that lead to the surface of the shroud band segment, and at least one fifth branch duct which extends essentially parallel to the at least one third cooling air branch duct and which is connected therewith via a plurality of the cooling air bores of the at least one third cooling air branch duct.

2. A turbine blade according to claim 1, wherein the cooling air branch duct, the at least one-third cooling air branch duct, and the fifth branch duct are oriented substantially in line with the blade reinforcing band and are closed off at the shroud band segment.

3. A turbine blade according to claim 1, wherein the cooling air bores of the cooling air branch duct and the cooling air bores of the at least one third cooling air branch duct extend substantially perpendicularly to the blade axis and extend from the surface of the shroud band segment at least to one of said cooling air branch duct and the fifth branch duct.

4. A turbine blade according to claim 3, wherein the fifth branch duct is situated in the trailing area of the blade.

5. A turbine blade according to claim 3, wherein the at least one first cooling air branch duct, the at least one third cooling air branch duct, and the fifth branch duct are oriented substantially in line with the blade reinforcing band and are closed off at the shroud band segment.

* * * * *